US011994340B2

(12) United States Patent
Jennie

(10) Patent No.: US 11,994,340 B2
(45) Date of Patent: May 28, 2024

(54) RIGID REFREEZABLE PORTABLE STORAGE CONTAINER INSERT

(71) Applicant: Scott M Jennie, S. Windsor, CT (US)

(72) Inventor: Scott M Jennie, S. Windsor, CT (US)

( * ) Notice: Subject to any disclaimer, the term of this patent is extended or adjusted under 35 U.S.C. 154(b) by 504 days.

(21) Appl. No.: 16/935,898

(22) Filed: Jul. 22, 2020

(65) Prior Publication Data

US 2020/0400360 A1 Dec. 24, 2020

Related U.S. Application Data

(63) Continuation of application No. 16/021,993, filed on Jun. 28, 2018, now Pat. No. 10,739,054.

(51) Int. Cl.
*F25D 3/08* (2006.01)
*F25D 23/06* (2006.01)

(52) U.S. Cl.
CPC ..... *F25D 3/08* (2013.01); *F25D 23/069* (2013.01); *F25D 2303/0831* (2013.01); *F25D 2303/0843* (2013.01); *F25D 2303/0845* (2013.01)

(58) Field of Classification Search
CPC .. F25D 3/08; F25D 23/069; F25D 2303/0831; F25D 2303/0843; F25D 2303/0845
See application file for complete search history.

(56) References Cited

U.S. PATENT DOCUMENTS 3,172,769 A 3/1965 Horan
3,958,359 A * 5/1976 Doughty ..... A01K 97/22 43/55
4,403,483 A 9/1983 Lisalda
5,050,335 A * 9/1991 Hisey ..... A01K 97/05 43/56
5,103,998 A * 4/1992 Caro ..... B65D 25/06 220/531
5,570,588 A 11/1996 Lowe
6,039,202 A * 3/2000 Olstad ..... F25D 23/069 220/23.88
6,112,899 A 9/2000 Zeringue
6,209,343 B1 4/2001 Owen
6,237,765 B1 5/2001 Hagen et al.
6,247,328 B1 6/2001 Mogil
6,490,880 B1 12/2002 Walsh
6,666,044 B2 12/2003 Gagnon
6,920,995 B2 * 7/2005 Bowen ..... A47F 3/0439 220/592.25
7,040,115 B1 5/2006 Lopez et al.
(Continued)

OTHER PUBLICATIONS

Tyco Healthcare / UNI-PATCH; Material Safety Data Sheet, Versa-Pac Reusable Heavy Duty Cold Pack; Feb. 2004; Rev. 2; Uni-Patch, Wabasha, MN 55981; (4 pages).

*Primary Examiner* — Emmanuel E Duke
(74) *Attorney, Agent, or Firm* — UConn IP Law Clinic; Meghan McDermott

(57) ABSTRACT

An apparatus is described herein for storing and transporting food and beverages, comprising a rigid housing configured to fit within a container, the housing comprising a base and a wall extending outwardly from the base, the wall having an inner layer and an outer layer defining a space therebetween, a refreezable material disposed in the space, and a divider panel configured to be removably mounted in the housing. Other products, systems and methods also are disclosed.

20 Claims, 6 Drawing Sheets

(56) References Cited

U.S. PATENT DOCUMENTS

| | | | | |
|---|---|---|---|---|
| 7,162,890 | B2 | 1/2007 | Mogil et al. | |
| 7,299,652 | B2 | 11/2007 | Gagnon | |
| 7,677,406 | B2 | 3/2010 | Maxson | |
| 8,209,995 | B2 | 7/2012 | Kieling et al. | |
| 8,863,546 | B2 | 10/2014 | Oberweis | |
| 9,205,962 | B2 | 12/2015 | Holderby | |
| 2003/0101744 | A1 | 6/2003 | Harper | |
| 2004/0238543 | A1* | 12/2004 | Askew | B65D 81/3816 220/529 |
| 2004/0262319 | A1* | 12/2004 | Fisher | F25D 3/08 220/528 |
| 2005/0109776 | A1* | 5/2005 | Camp | A45C 11/20 220/23.86 |
| 2007/0180850 | A1 | 8/2007 | Thompson | |
| 2011/0005240 | A1* | 1/2011 | Chapa | F25D 3/08 62/457.2 |
| 2011/0203297 | A1* | 8/2011 | Oberweis | F25D 3/14 62/383 |
| 2016/0244239 | A1 | 8/2016 | Nash | |
| 2018/0148221 | A1 | 5/2018 | Hill | |
| 2018/0346229 | A1* | 12/2018 | Guerdrum | B65D 21/086 |
| 2018/0360178 | A1* | 12/2018 | Bungert | A45C 13/02 |

* cited by examiner

RIGID REFREEZABLE PORTABLE STORAGE CONTAINER INSERT

CROSS-REFERENCE TO RELATED APPLICATIONS

This is a continuation of U.S. application Ser. No. 16/021,993 filed Jun. 28, 2018.

BACKGROUND

The disclosed embodiments relate to the field of rigid inserts for portable storage containers.

Typical portable storage containers are made of non-insulating material and are not easily refrigerated, making them notorious for failing to keep comestibles and beverages fresh and cold. Current potential solutions to this problem are flawed. For instance, one known solution is a soft-sided, collapsible insert that insulates the comestibles and/or beverages within or allows for ice packs to be inserted in the walls. This simply delays the inevitable spoiling of the contents because it passively prevents heat from escaping and, if ice packs are used, requires the storage and refreezing of several bulky ice packs. Another solution is to replace the food container with a rigid, insulated container but the addition of the insulating layer can make the container bulky and hard to carry.

It is therefore seen that there exists a need in the art to overcome the deficiencies and limitations described herein and above.

SUMMARY

One embodiment described herein is an apparatus, comprising a rigid housing configured to fit within a portable storage container. The housing comprises a base and a wall extending outwardly from the base, the wall having an inner layer and an outer layer defining a space therebetween that is configured to receive a refreezable material. The apparatus also includes a divider panel configured to be mounted in the housing.

Another embodiment described herein is an apparatus comprising a rigid housing configured to fit within a portable storage container. The housing comprises a base and a wall extending outwardly from the base, the wall having an inner layer and an outer layer defining a space therebetween that is configured to receive a refreezable material. In embodiments, the inner and out layers of the walls comprise a polymeric material, and the space between the inner and outer layers has a thickness in the range of about 4 mm to about 8 mm. In embodiments, the overall wall thickness of the housing is in the range of about 7 mm to about 15 mm.

Another embodiment described herein is an apparatus comprising a rigid, unitary housing configured to fit within a portable storage container, the housing comprising a base and a wall extending outwardly from the base, the wall having an inner layer and an outer layer defining a space therebetween. The wall is configured to allow the housing to nest in another housing. A refreezable material is disposed in the space.

A further embodiment is an apparatus comprising a first divider panel and a rigid housing configured to fit within a portable storage container. The housing comprises a base including an interior surface and an exterior surface, and a wall extending outwardly from the base, forming an interior space. The wall has an inner layer and an outer layer defining a refreezable material space therebetween that is configured to receive a refreezable material. At least one of the inner layer of the wall and the interior surface of the base includes a first channel configured to support the first divider panel in the interior space of the housing.

A further embodiment is an apparatus comprising a rigid, unitary housing configured to fit within a portable storage container. The housing comprises a base including an interior surface and an exterior surface, and a wall extending outwardly from the base, forming an interior space. The wall has an inner layer and an outer layer defining a refreezable material space therebetween, the base being rectangular with a rigid protrusion that is dimensioned to be inserted vertically within the wall of another housing. A refreezable material is disposed in the refreezable material space.

DETAILED DESCRIPTION

Figure 1:
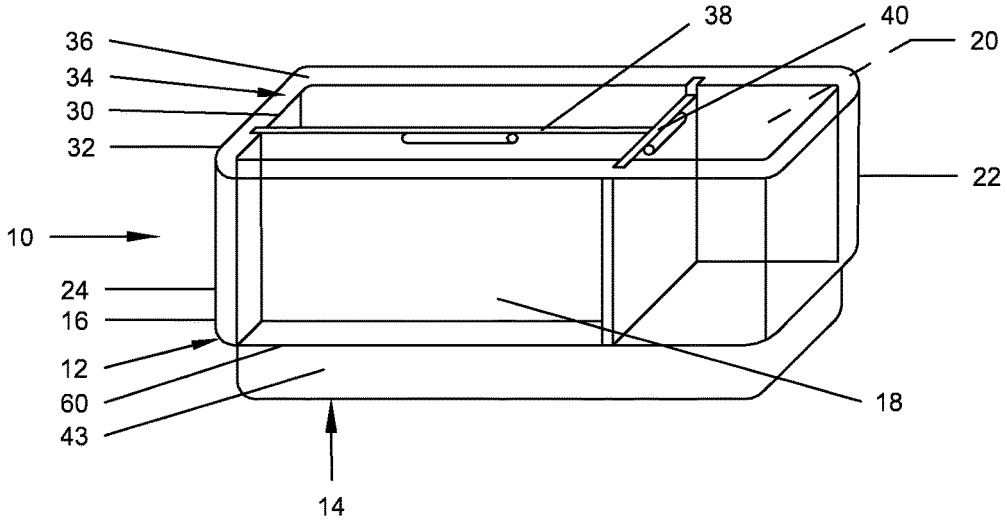
FIG. 1 shows a perspective view of a first embodiment of a portable storage container insert.

Standard school lunch boxes may not necessarily keep lunches fresh and cold. The embodiments described herein provide a rigid insert for a lunch box with hollow walls that are filled with a refreezable material. The insert comprises a housing that can be stored overnight in a freezer. The housing is designed such that multiple units can stack on top of each other. In embodiments, the walls are contoured and there is a protrusion on the bottom that will fit into the top of another unit. In some cases, the lower interior or exterior surface of the base is configured to store one or more rigid divider panels that can be mounted to fit within the walls to segment the interior of the food container insert. The material that is within the walls comprises a refreezable material.

Referring to the drawings, FIGS. 1-7 show a first embodiment of a food container insert 10. The food container insert 10 is an apparatus configured to hold comestibles and/or beverages, i.e. ingestible substances. The insert 10 includes a rigid housing 12. The housing 12 includes a base 14 and a wall 16 extending outwardly from the base 14. In the embodiment shown in FIGS. 1-7, the base 14 is rectangular and the wall 16 includes a front wall segment 18 and an opposite back wall segment 20. The wall 16 further includes a first end wall segment 22 and an opposite second end wall segment 24, providing the food container insert 10 with a generally rectangular shape. The base 14 and wall 16 together include a rigid inner layer 30 and a rigid outer layer 32 which define a space 34 that is filled with a refreezable material 36. The dimensions of the base 14 and wall 16 of the housing 12 are selected such that the insert 10 fits within a food container 50.

As mentioned above, the wall 16 is rigid. The wall 16 can be made of a thermoplastic material, a thermoset material or another suitable material. The interior space 42 that will contain the food and/or drink is defined by the wall 16 and the base 14. In some embodiments, the housing 12 is formed by molding the walls to a rigid base, and the refreezable material in the base is separate from the refreezable material in the wall. In other embodiments, the housing is formed such that the refreezable material, when in the form of a fluid, can move from the base section to the wall section. Details of the methods of making these embodiments are provided below.

The base 14 comprises a planar upper wall 60 and a rigid protrusion 43 extending outwardly therefrom. The protrusion 43 has an outer rectangular dimension that generally matches the rectangular dimension of the inner layer 30 of the wall 16 and creates a storage space 44, which is part of the interior space 42 between stacked housings.

Figure 2:
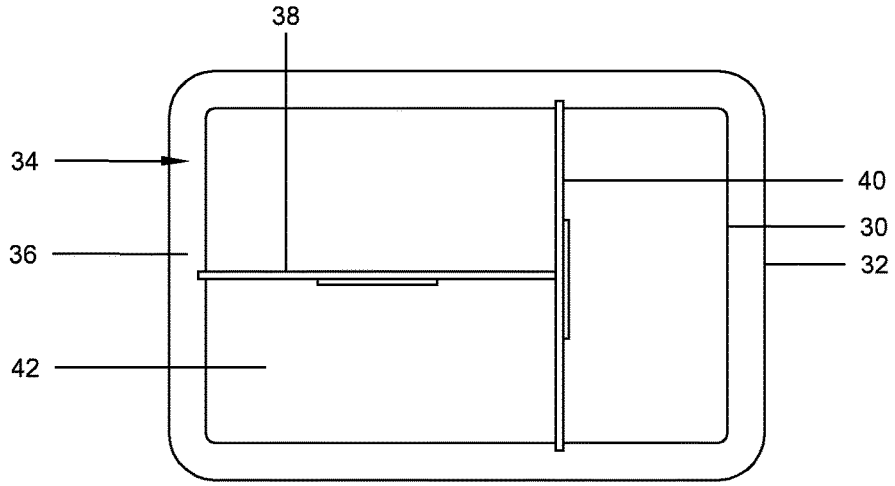
FIG. 2 is a top plan view of the embodiment of FIG. 1.
Figure 3:
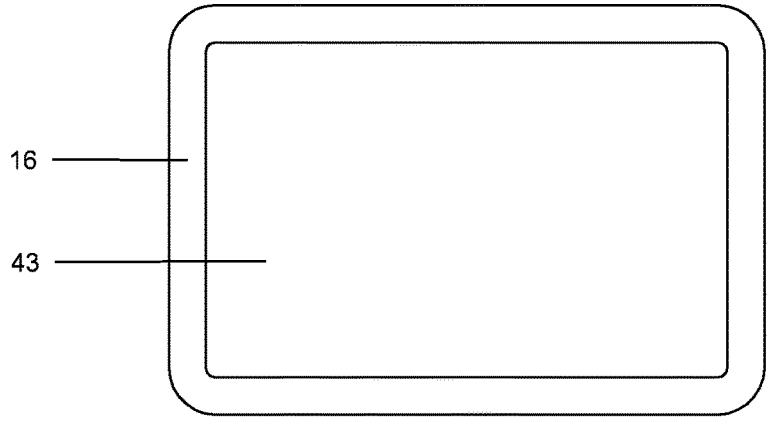
FIG. 3 is a bottom plan view of the embodiment of FIG. 1.
Figure 4:
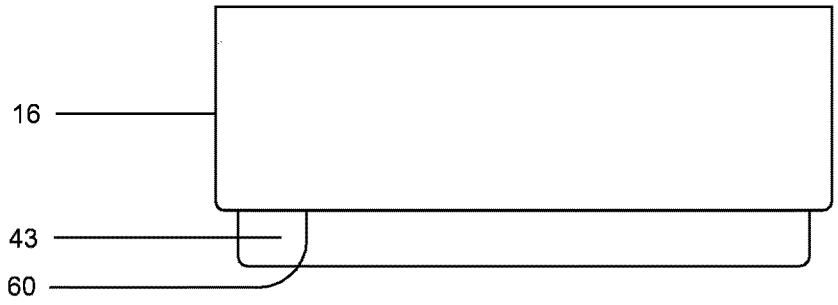
FIG. 4 is a side view of the embodiment of FIG. 1.
Figure 5:
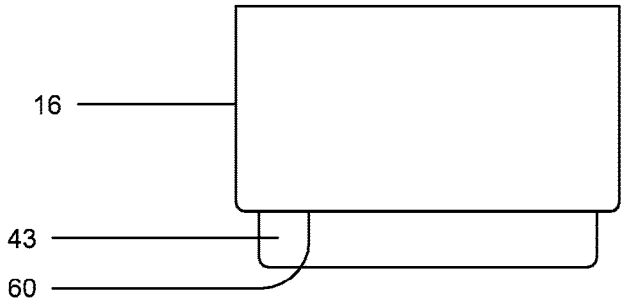
FIG. 5 is an end view of the embodiment of FIG. 1.
Figure 6:
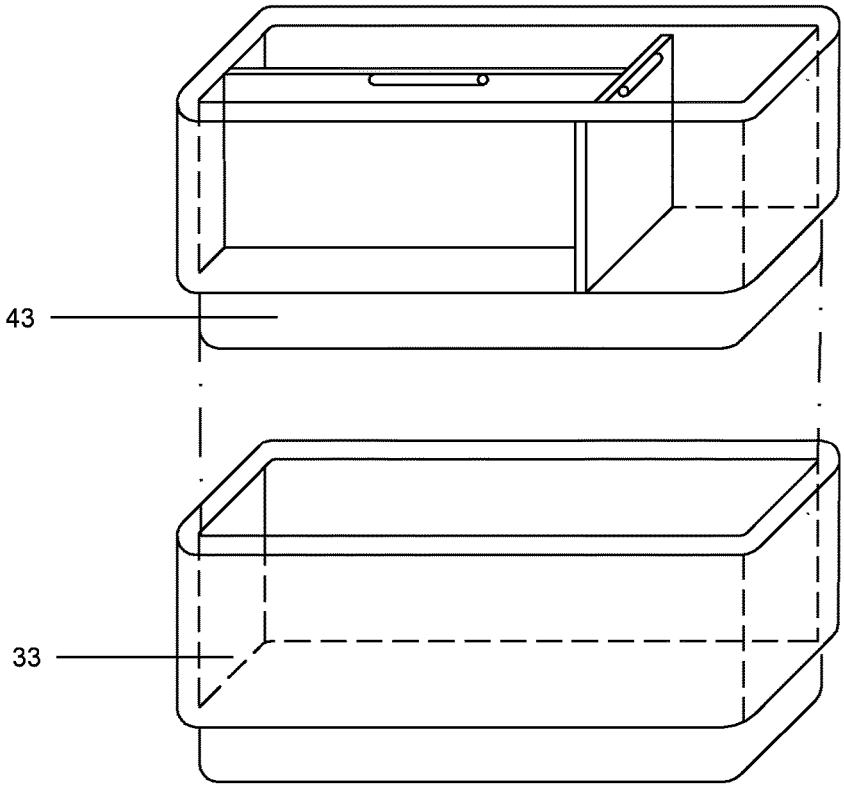
FIG. 6 is a perspective view of the embodiment of FIG. 1, illustrating a method of stacking multiple portable storage container inserts.
Figure 7:
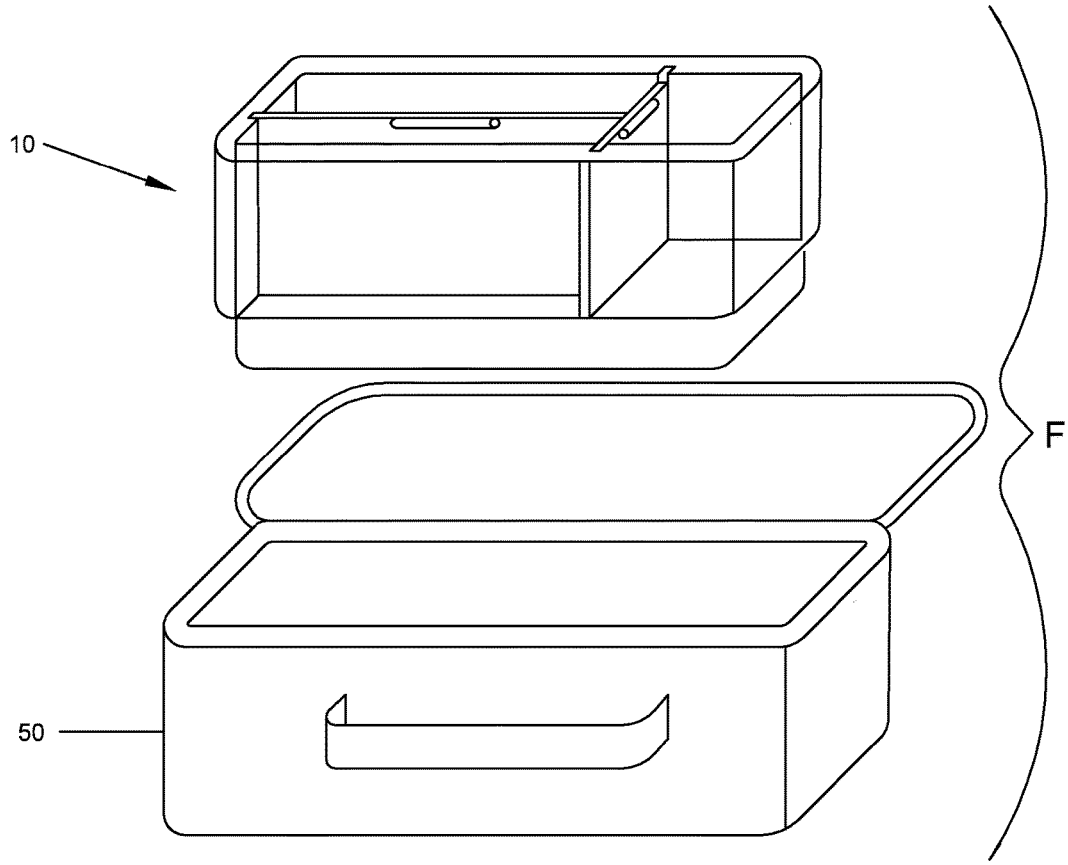
FIG. 7 shows a perspective view of the embodiment of FIG. 1, illustrating a method of placing a portable storage container insert into a portable storage container.
Figure 8:
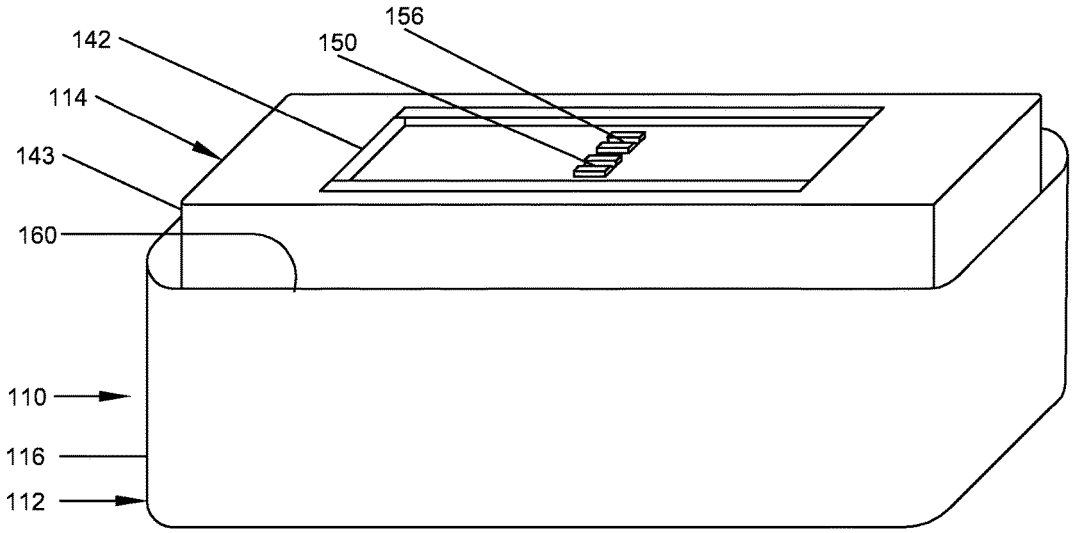
FIG. 8 is a perspective view of a second embodiment of a portable storage container insert, showing a bottom surface including a recessed area for removable divider panel storage.
Figure 9:
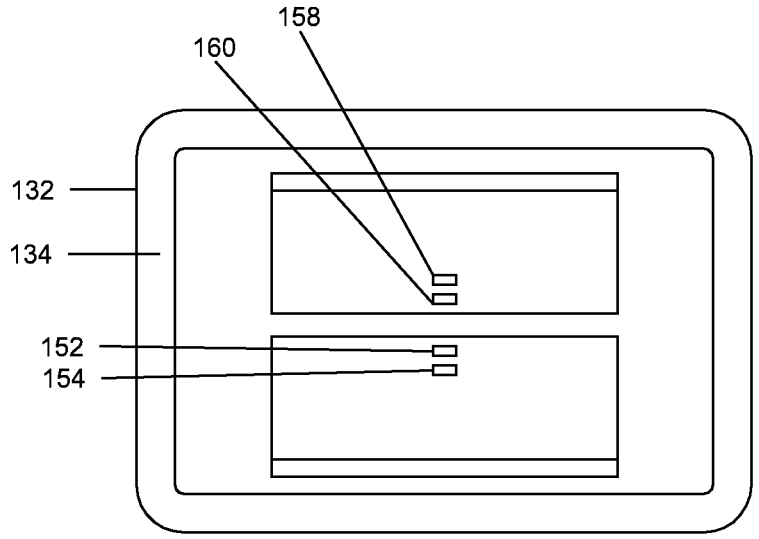
FIG. 9 is a bottom plan view of the embodiment of FIG. 8.
Figure 10:
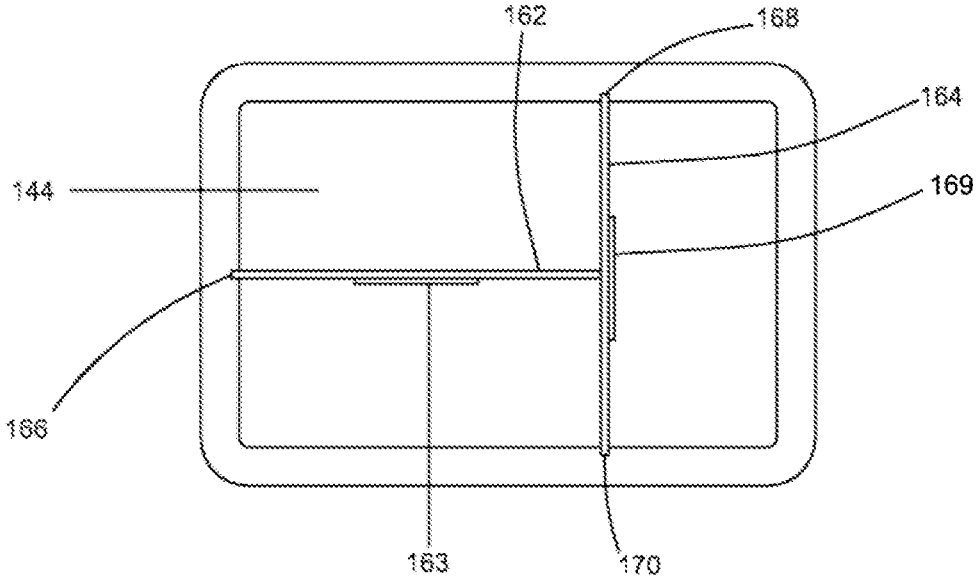
FIG. 10 is a top plan view of the embodiment of FIG. 8, showing the divider panels mounted for use.

In the embodiment shown in FIGS. 1-7, there are a first divider panel 38 and second divider panel 40 which are removable and can be used within the insert 10 by mounting them in a suitable arrangement, such as a T-shape as is shown in FIGS. 1-2, to segment the space within the base 14 and wall 16 into three separate segments.

The base 14 is manufactured to fit within a lunch box. The walls 16 are shaped to fit within the lunch box and also to allow stacking of one unit on top of another for freezing and/or storage. The protrusion 43 contains a refreezable material. When the inserts are stacked, one upon another, the interior space 33 between adjacent inserts can be used to store divider panels 38, 40 when they are not in use.

FIGS. 8-11 show a second embodiment that includes fixed storage for the divider panels when they are not in use. In the embodiment shown in FIGS. 8-10, the food container insert 110 includes a rigid housing 112. The housing 112 includes a base 114 and a wall 116 extending outwardly from the base 114. A rigid protrusion 143 extends outwardly from the planar upper wall 160 of the base 114 with an outer dimension that generally matches the dimension of the inner layer 130 of the wall 116. The protrusion 143 includes an indented section 142 that is sized to receive the first divider panel 162 and the second divider panel 164 when they are not mounted within the interior space 144. The first divider panel 162 includes a projection 163 to facilitate storage. The second divider panel 164 includes a projection 165 to facilitate storage. Within the indented section 142, there is a first clamp 150 that includes a first segment 152 and a second segment 154 that are configured to hold the projection 163. Within the indented section 142, there is a second clamp 156 that includes a first segment 158 and a second segment 160 that are configured to hold the projection 169.

Figure 11A:
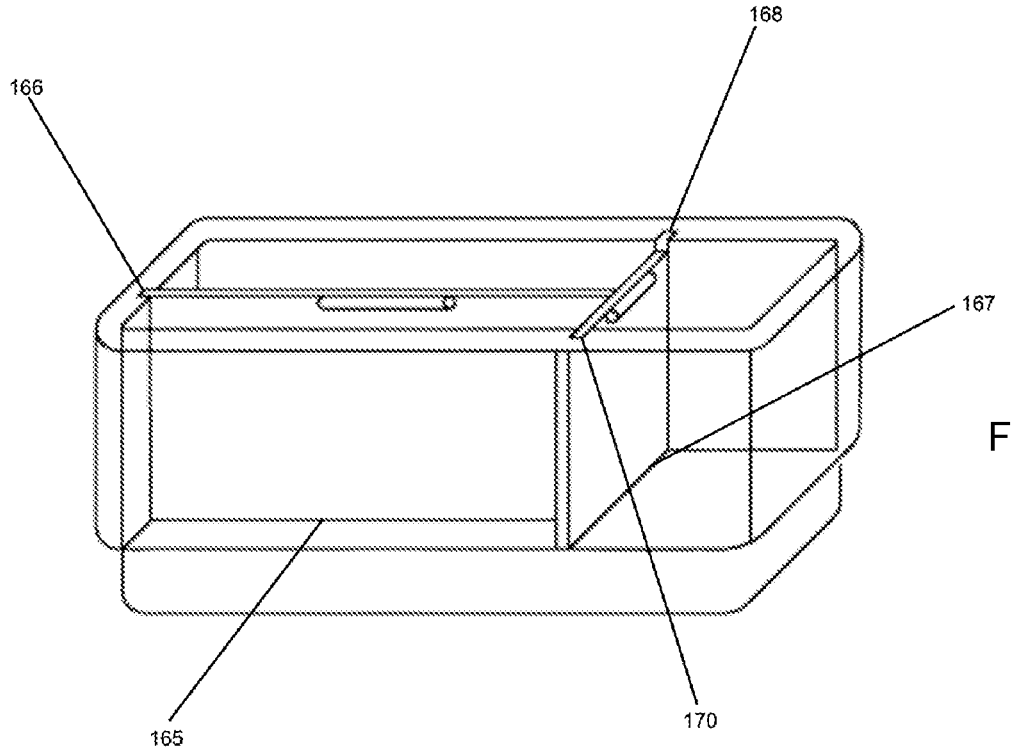
FIG. 11A is a top perspective view of the embodiment of FIG. 8, showing the channels.
Figure 11B:
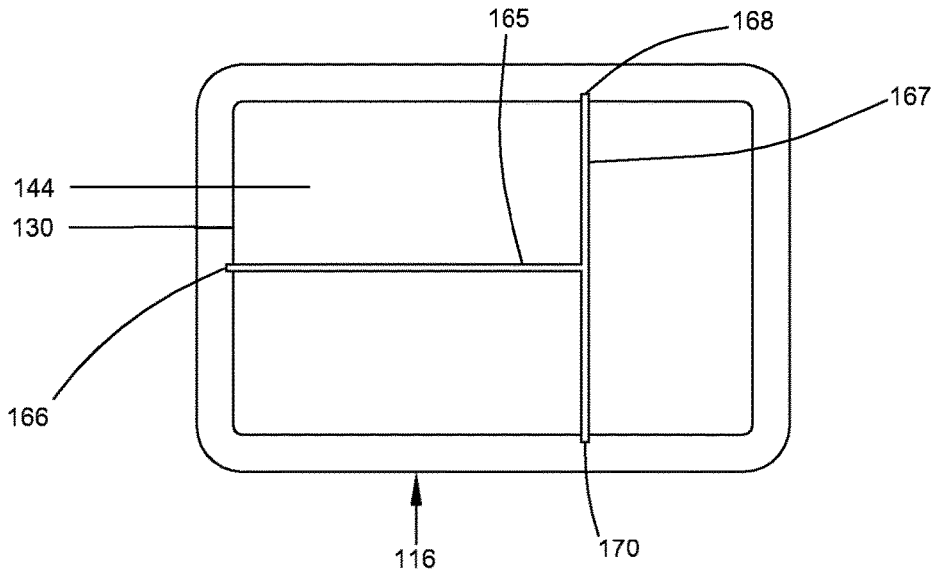
FIG. 11B is a top plan view of the embodiment of FIG. 8, showing the divider panels removed.

FIG. 11B shows the housing 116 with the first divider panel 162 and the second divider panel 164 removed to show a first channel 166 configured to receive the first divider panel 138 and a second channel 167 configured to receive the second divider panel 164. The inner layer 130 of the wall 116 comprises a first groove 166 which is aligned with the first channel 165 to receive and support the first divider panel 162. The inner layer 130 of the wall 116 also includes a second groove 168 which is opposite a third groove 170. The grooves 168, 170 are aligned with the second channel 167 and are configured to receive and support the second divider panel 164.

The rigid protrusion 143 can be inserted within another housing 112 such that the outer layer 132 of the base 114 of an upper housing 112 will rest on the top of the wall 116 of a lower housing 112. This can be repeated to stack multiple containers for storage. The dimensions of the base 114 and wall 116 of the housing 112 are such that the insert 110 fits within a food container 50.

In the embodiments of FIGS. 1-13, the housing includes a base and wall that can be made of a rigid thermoplastic or thermoset material, a metal, or a rigid composite. The first divider panel and second divider panel optionally can be made of the same material as the base and wall. The refreezable material comprises a liquid such as water, a gel, or another refreezable material. In some cases, the refreezable material comprises at least 50 wt % water and also comprises at least one of propylene glycol, ethylene glycol and an antibacterial material. The antibacterial material can be incorporated to prevent the growth of bacteria in the space between in inner and outer walls of the housing. In some cases, a gel can be formed using a suitable material. Non-limiting examples of gel forming materials include a combination of water and hydroxyethyl cellulose, sodium polyacrylate or silica gel.

In the embodiments shown in FIGS. 1-11, the base 14, 114 and wall 16, 116 are generally perpendicular to one another with a sharp edge. In other embodiments, the wall may be gently tapered or curved (without a protrusion) to enable multiple housings to be stacked on one another.

In some cases, the housing is configured as a lunch box, and has an external length for the upper section in the range of about 20 cm to about 30 cm, or about 24 cm to about 28 cm, or about 25 to about 27 cm. In embodiments, the lower section of the housing, which is configured to nest inside another housing, has an external length in the range about 17.5 cm to about 27.5 cm, or about 21.5 cm to about 25.5 cm, or about 22.5 cm to about 24.5 cm. In some cases, the housing has an external width for the upper section in the range of about 16 cm to about 25 cm, or about 17 cm to about 20 cm, or about 18 to about 19 cm. In embodiments, the lower section of the housing, which is configured to nest inside another housing, has an external width in the range about 14.5 cm to about 22.5 cm, or about 14.5 cm to about 17.5 cm, or about 15.5 cm to about 16.5 cm. In some cases, the housing has an external height in the range of about 6 cm to about 22 cm, or about 7 cm to about 15 cm, or about 8 cm to about 13 cm. The height of the upper portion, not including the base, typically is in the range of about 5 cm to about 15 cm, or about 6 cm to about 13 cm, or about 7 cm to about 12 cm.

In embodiments, the inner and out layers of the walls comprise a polymeric material, and the space between the inner and outer layers has a thickness in the range of about 3 mm to about 8 mm, or about 4 mm to about 7 mm. In embodiments, the overall wall thickness of the housing is in the range of about 7 mm to about 15 mm. In some cases, the inner wall has a thickness in the range of about 0.5 to about 3 mm, or about 1 mm to about 2 mm, or about 1 mm to about 1.5 mm. In some cases, the outer wall has a thickness in the range of about 0.5 to about 3 mm, or about 1 mm to about 2 mm, or about 1 mm to about 1.5 mm. In embodiments, the overall thickness of the base is in the range of about 10 mm to about 20 mm, or about 12 mm to about 16 mm, or about 12 mm to about 14 mm. When the base is formed as a separate hollow component such that the liquid and/or gel in the base cannot enter the wall, the inner and outer wall thickness typically are within the ranges provided above for the wall of the housing. When the base is integrally formed with the wall such that liquid and/or gel can flow between the base and the wall, the inner and outer wall thickness typically are within the ranges provided above for the wall of the housing. In some cases, the outer wall of the base is thicker than the inner wall of the base in order to provide enhanced stability to the housing.

Figure 12:
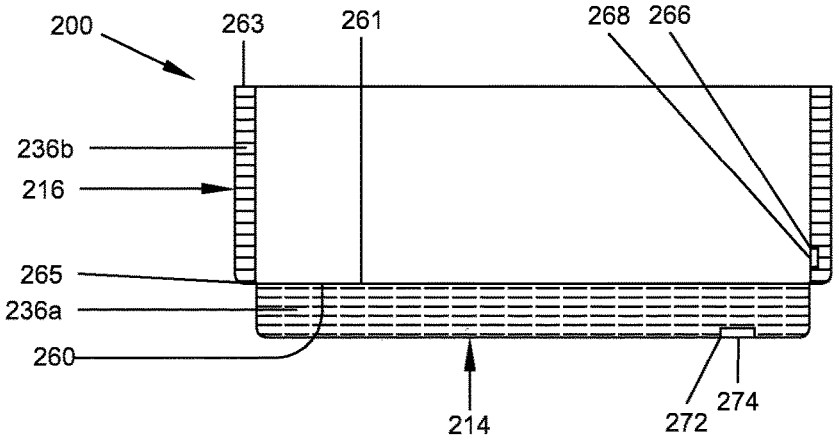
FIG. 12 is a side view showing the construction of the insert in accordance with a first method of making the housing.
Figure 13:
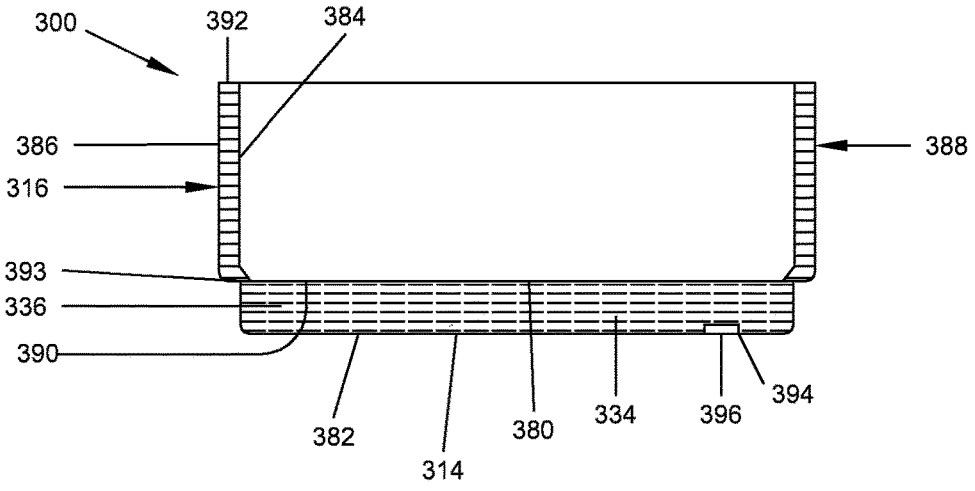
FIG. 13 is a side view showing the construction of the insert in accordance with a second method of making the housing.

Various techniques can be employed to make the housing. FIGS. 12-13 are non-limiting examples showing embodiments made by two different methods. In the housing shown in FIG. 12, designated as 200, the refreezable material 236*a* in the base 214 is separate from the refreezable material 236*b* in the wall 216. This embodiment can be made by separately forming the base 214, molding a wall 216 and joining it to the base. In this embodiment, the base includes an upper wall 260. In this embodiment, the wall 216 may include a relatively thin, rectangular, planar connector 261 that connects the four wall sections to one another and is configured to be connected to the upper wall 260 of the base 214. The wall 216 is closed at its upper end with wall section 263 and at its lower end with wall section 265. The wall 216 can be molded onto the base 214, the base 214 can be molded onto the wall 216, or the two sections can be joined with an adhesive, by welding, or using another suitable technique after being separately molded. Liquid can be inserted into the wall 216 through aperture 266 and the wall 216 can be sealed with a plug 268. Liquid can be inserted into the base 214 through aperture 272 and sealed with a plug 274.

The housing 300 of FIG. 13 is made by separately molding a first component 388 that includes the outer wall 382 of the base 314, the lower wall section 393 and the outer wall section 386 of the wall 316, and a second component 390 that includes the inner layer 380 of the base 314 and the inner layer 384 of the wall 316. The upper wall section 392 can be part of the first component 388, the second component 390, or can be a separate piece. The first component 388 and second component 390 are joined by ultrasonic welding or another suitable technique. Thus, the base and walls initially are hollow. The space 334 is subsequently filled with a refreezable material 336 through an aperture 394 and the aperture is sealed with a plug 396. When in liquid form, the refreezable material 336 can move between the wall 316 and the base 314.

In embodiments, the base thickness, the wall dimensions and spacing are configured to keep comestibles and/or beverages that need refrigeration fresh and consumable for at least 5 hours, or at least 8 hours, or at least 12 hours. In embodiments, the comestibles and/or beverages are maintained at a temperature of less than 41 deg. F. or less for at least 2 hours, or at least 4 hours, or at least 8 hours.

In some cases, a separate cold pack is positioned on top of the comestibles and/or beverages and typically is dimensioned to generally conform to the inner length and width of the housing. The cold pack can contain a refreezable material.

The refreezable material can be a liquid and/or gel, and may be water or a chemical composition that optionally can include water. Non-limiting examples of suitable materials to mix with water include propylene glycol, ethylene glycol and alcohol. A suitable gas space is included in the space containing the refreezable material when the walls and base are filled to allow for expansion and contraction of the wall contents.

The embodiments shown in FIGS. 1-10 are not meant to preclude other shapes of the housing 12, 112 which will be formed to fit the container 50, which could also be round, oval, pentagonal, hexagonal or a custom shape.

A number of alternatives, modifications, variations, or improvements therein may be subsequently made by those skilled in the art, which are also intended to be encompassed by the following claims.

What is claimed is:

1. An apparatus, comprising:

a first divider panel, and a rigid housing configured to fit within a portable storage container, the housing comprising a base including an interior surface and an exterior surface, and a vertical wall having a length and extending outwardly from the base, forming an interior space, the vertical wall including first, second, third and fourth rectangular wall sections each having an inner layer and an outer layer defining a refreezable material wall space therebetween that is configured to receive a refreezable material, the vertical wall having a single aperture configured to receive the refreezable material within all of the first, second, third and fourth wall sections, the inner layer of the vertical wall including a first vertical channel that extends along substantially the entire length of the vertical wall, the first vertical channel being configured to support the first divider panel in the interior space of the housing.

2. The apparatus of claim 1, wherein the base includes an inner layer and an outer layer defining a refreezable material base space therebetween that is configured to contain a refreezable material, and wherein both the refreezable material base space and the refreezable material wall space can be filled with a refreezable material through the single aperture.

3. The apparatus of claim 1, wherein the first divider panel is configured to be removably mounted in the housing.

4. The apparatus of claim 1, wherein the housing is configured to hold ingestible substances.

5. The apparatus of claim 1, wherein the base is configured to allow the housing to nest in another housing.

6. The apparatus of claim 1, further comprising a divider storage compartment formed on the housing.

7. The apparatus of claim 1, further comprising a second divider panel configured to be mounted in the housing.

8. The apparatus of claim 7, wherein at least one of the first divider panel and the second divider panel can be stored in the interior space when not in use.

9. The apparatus of claim 1, wherein the interior surface of the base is generally flat and includes a first horizontal channel recessed relative to the interior surface of the base, the first horizontal channel being configured to support the first divider panel in the interior space of the housing.

10. The apparatus of claim 9, wherein at least one of the inner layer of the first vertical wall and the interior surface of the base includes a recessed second channel configured to support a second removable divider panel in the interior space of the housing.

11. The apparatus of claim 10, wherein the recessed second channel includes a vertical recessed second channel extending substantially along the entire length of the inner layer of the vertical wall and a horizontal recessed second channel extending along the interior surface of the base.

12. The apparatus of claim 1, wherein the portion of the first channel and the portion of the second channel that are formed on the interior surface of the base are perpendicular to one another.

13. The apparatus of claim 1, wherein the apparatus is dimensioned to fit entirely inside a lunch box.

14. The apparatus of claim 1, wherein the interior surface of the base is formed by an inner base component and the exterior surface of the base is formed by an outer base component, and the outer base component is thicker than the inner base component to provide enhanced stability to the apparatus.

15. An apparatus, comprising:

a rigid, unitary housing configured to fit within a portable storage container, the housing comprising a base including an interior surface and an exterior surface, and a wall extending outwardly from the base, forming an interior space, the wall having an inner layer and an outer layer defining a refreezable material wall space therebetween filled with a refreezable material, the base being rectangular with a rigid protrusion having an outer rectangular dimension shaped to generally match the rectangular dimension of the inner layer of the wall of the interior space of housing in order that the rigid protrusion can be inserted vertically within the interior space of another apparatus of the same configuration, the base being formed with an inner layer and an outer layer defining a refreezable material base space therebetween filled with the refreezable material, a single aperture formed on either the wall or the base, the single aperture being configured to receive the refreezable material to fill both the refreezable material wall space and the refreezable material base space.

16. The apparatus of claim 15, wherein the housing is configured to receive a removable divider panel.

17. The apparatus of claim 15, wherein the apparatus further comprises a first removable divider panel.

18. The apparatus of claim 15, wherein the refreezable material comprises at least one of a liquid and a gel.

19. The apparatus of claim 15, wherein the housing is configured to hold ingestible substances.

20. The apparatus of claim 15, further comprising a first divider panel storage compartment formed on the housing.

* * * * *